US009609921B1

(12) United States Patent
Feinstein

(10) Patent No.: US 9,609,921 B1
(45) Date of Patent: Apr. 4, 2017

(54) SELF-FITTING, SELF-ADJUSTING, AUTOMATICALLY ADJUSTING AND/OR AUTOMATICALLY FITTING MAGNETIC CLASP

(71) Applicant: Peter A. Feinstein, Shavertown, PA (US)

(72) Inventor: Peter A. Feinstein, Shavertown, PA (US)

(73) Assignee: Feinstein Patents, LLC, Wilkes-Barre, PA (US)

( * ) Notice: Subject to any disclaimer, the term of this patent is extended or adjusted under 35 U.S.C. 154(b) by 0 days.

(21) Appl. No.: 15/061,447

(22) Filed: Mar. 4, 2016

(51) Int. Cl.

| | |
|---|---|
| ***H02K 7/14*** | (2006.01) |
| ***A44C 5/20*** | (2006.01) |
| ***A44C 5/18*** | (2006.01) |
| ***F16M 13/04*** | (2006.01) |
| ***G05B 19/409*** | (2006.01) |

(Continued)

(52) U.S. Cl.
CPC ..... *A44C 5/2071* (2013.01); *A44C 5/185* (2013.01); *F16M 13/04* (2013.01); *G05B 11/01* (2013.01); *G05B 19/409* (2013.01); *G06F 1/163* (2013.01); *H02P 1/02* (2013.01); *H02P 3/02* (2013.01); *H03K 17/962* (2013.01);

(Continued)

(58) Field of Classification Search
CPC ..... A44C 5/2071; A44D 2203/00; B60R 2022/4816; B60R 2022/4841; B60R 2022/4858; B60R 2022/4866; B60R 22/38; B60R 22/41; B60R 22/48; B64D 11/06; B64D 11/062; Y10T 24/2155; Y10T 24/32; Y10T 24/47
USPC ..... 318/3, 6.7
See application file for complete search history.

(56) References Cited

U.S. PATENT DOCUMENTS 4,399,595 A 8/1983 Yoon et al.
4,941,236 A * 7/1990 Sherman ..... A44C 5/2071 24/265 WS (Continued)

FOREIGN PATENT DOCUMENTS

WO 2011141061 A1 11/2011
WO 2015114301 A1 8/2015

OTHER PUBLICATIONS

Pending U.S. Appl. No. 14/611,80, filed Feb. 2, 2015 (not yet published) Title: Hybrid Smart Assembling 4D Material Inventor: Peter Feinstein 39 pages.

*Primary Examiner* — Paul Ip
(74) *Attorney, Agent, or Firm* — St. Onge Steward Johnston & Reens, LLC

(57) ABSTRACT

Provided is an automatically adjustable clasp having two separable magnet pieces which may magnetically adhere to each other to form a closed clasp. The clasp also includes a motor, an anchor mechanism for attaching the clasp to a band, sensors, and a control unit. The sensors acquire and send information related to the clasp or the band to the control unit, which may activate the motor. The activation of the motor changes the position of the anchor mechanism with respect to the rest of the clasp, thereby loosening or tightening of the band attached to the anchor mechanism. Also provided is a wearable band with the automatically adjustable clasp. The wearable band may include a shape memory material such that the band may self-assemble around a body part when a stimulus is applied to the shape memory material. The self-assembly process may enable the automatic clasp of the magnet pieces.

28 Claims, 8 Drawing Sheets

(51) Int. Cl.

| | |
|---|---|
| ***G05B 11/01*** | (2006.01) |
| ***H02P 1/02*** | (2006.01) |
| ***H02P 3/02*** | (2006.01) |
| ***H05K 9/00*** | (2006.01) |
| ***G06F 1/16*** | (2006.01) |
| ***H03K 17/96*** | (2006.01) |

(52) U.S. Cl.
CPC ..... *H03K 17/9627* (2013.01); *H03K 17/9645* (2013.01); *H05K 9/0075* (2013.01); *G05B 2219/37187* (2013.01)

(56) References Cited

U.S. PATENT DOCUMENTS

| | | | | |
|---|---|---|---|---|
| 5,050,276 | A | 9/1991 | Pemberton | |
| 6,052,828 | A | 4/2000 | Widdemer | |
| 6,675,610 | B2 | 1/2004 | Beard | |
| 6,910,273 | B2 | 6/2005 | Beard | |
| 6,998,984 | B1 | 2/2006 | Zittrain et al. | |
| 7,310,895 | B2 | 12/2007 | Whittlesey et al. | |
| 7,874,590 | B1 * | 1/2011 | Schubert | B60R 22/38 280/806 |
| 8,539,652 | B2 | 9/2013 | Richardson | |
| 8,769,844 | B2 | 7/2014 | Beers et al. | |
| 9,141,086 | B1 | 9/2015 | Rohrbach | |
| 9,144,273 | B2 | 9/2015 | Wu et al. | |
| 9,202,616 | B2 | 12/2015 | Fullerton et al. | |
| 2004/0025984 | A1 | 2/2004 | Holemans et al. | |
| 2004/0221614 | A1 | 11/2004 | Holemans et al. | |
| 2012/0110792 | A1 | 5/2012 | Granito | |
| 2012/0314546 | A1 | 12/2012 | Brewer et al. | |
| 2013/0326790 | A1 | 12/2013 | Cauwels et al. | |
| 2014/0007387 | A1 | 1/2014 | Voinov | |
| 2014/0053602 | A1 | 2/2014 | Catheline et al. | |
| 2014/0068838 | A1 | 3/2014 | Beers et al. | |
| 2014/0338225 | A1 | 11/2014 | Bliss | |
| 2015/0223573 | A1 | 8/2015 | Vecchione | |
| 2015/0227245 | A1 | 8/2015 | Inagaki et al. | |
| 2015/0289607 | A1 | 10/2015 | Lee et al. | |
| 2015/0335284 | A1 | 11/2015 | Nuovo et al. | |

* cited by examiner

SELF-FITTING, SELF-ADJUSTING, AUTOMATICALLY ADJUSTING AND/OR AUTOMATICALLY FITTING MAGNETIC CLASP

FIELD OF THE INVENTION

This disclosure relates generally to a clasp, more particularly to a magnetic clasp with self-fitting, self-adjusting, automatically adjusting and/or automatically fitting ability.

BACKGROUND OF THE INVENTION

Electronic devices and other apparatuses, such as wearable devices like smart watches, heart rate monitors, or fitness monitors, may be attached to one or more body parts of a user utilizing attachment structures such as bands. To meet various fitting requirements, it is preferred that wearable bands are adjustable in terms of length. It is also preferred that wearable bands can automatically adjust the band length to maintain desired tightness during wearing. It is further preferred that wearable bands, especially those to be worn on a wrist or arm, require very simple one-handed operation. Most preferable would be a wearable band that required no use of the opposite hand other than to position or place the object on the desired location after which the band is capable of completing the attachment by itself automatically as a hands free operation.

Conventional bands include expanding linkages and non-expanding linkages. Conventional bands, such as watch bands, jewelry bands, magnetic health bands, bracelets, and necklaces, however, often are very delicate and flimsy and do not hold up well to physical exercise, fitness activities and sports.

Most conventional bands use clasps to open and close bands. Traditional clasp mechanisms come in various forms. Buckle and strap clasp mechanisms rely on mechanical features to keep the band or flap closed. Buckle and strap mechanisms can provide one-handed operation and can be adjusted, but they are not easy to use in one handed operation. Hook and loop clasps, such as Velcro-like fasteners can be adjusted and open or closed by one hand, but they are not aesthetically pleasing. Button and hole clasps can be adjustable if there are multiple holes, but they are difficult to operate one-handed and the length adjustment is limited by the locations of the holes. Magnetic closure mechanisms use a post and hole configuration for alignment of the magnetic closure for mechanical retention in shear. Such magnetic closures are operable by one-hand but have limitations.

Generally, conventional bands with clasps provide very limited flexibilities for users to adjust and obtain the most comfortable tightness for the straps when the bands are put on a body part. None of those bands can further automatically adjust the fitting of the bands which may become loose or tight during wearing as a result of a person's daily activities.

There is still a need to provide an improved wearable band which is adjustable in length and suitable for one handed or even hands free operation. Desirably, the wearable band is able to clasp automatically upon putting onto a body. It would also be desirable for the wearable band to be able to automatically adjust the tightness of the band immediately after clasping and also during a course of daily activities.

SUMMARY OF THE INVENTION

It is an object of the present invention to provide a wearable band with a clasp which is adjustable in length and suitable for very simple one handed or hands free operation.

It is another object of the present invention to provide a wearable band with a clasp which can automatically assembly around a body part upon laying onto the body part, and further automatically adjust the tension of the strap to achieve a desired fitting (a hands free operation).

It is a further object of the present invention to provide a wearable band with a clasp which can automatically loosen or tighten the strap during wearing in order to substantially maintain a desired tightness level during a course of daily activities.

The present invention achieves the objects by providing a magnetic clasp with self-fitting, self-adjusting, automatically adjusting and/or automatically fitting ability, which preferably, is attached to a band which comprises a shape memory material.

According to one embodiment, the present invention provides an automatically adjustable and/or automatically fitting clasp, which comprises a first clasp member having a first magnet piece and a second clasp member having a second magnet piece. The first and the second clasp members are separated from one another in an open position of the clasp and mutually attract and magnetically connect to each other to form an overlap in a closed position of the clasp. The self-adjusting clasp further comprises a motor disposed on one of the clasp members and an anchor mechanism coupled to each of the clasp members for attaching the clasp to a band. The clasp may also comprise one or more sensors and a control unit. The sensors acquires information related to the clasp or the band and send sensed information to the control unit. The control unit then triggers the activation of the motor based on the sensed information. The movement of the motor changes the relative position of the anchor mechanism with respect to the rest of the clasp, thereby loosening or tightening of the band attached to the anchor mechanism.

The closed clasp may have a tab, an indentation, or a button on an edge of the clasp members so that a user may easily lift up or push away one of the clasp members with a finger in order to open the engaged clasp members. There may also be a tab, indentation, or button present for manual operation of loosening and tightening of the band as an alternative to sensor feedback and control.

One advantage of the magnetic clasp of the present invention is that the clasp, as well as a band coupled with the clasp, can be easily operated with a single hand. Once the band is worn properly, the built-in motor can automatically adjust and substantially maintain a preferred tightness of the strap during wearing.

In some preferred embodiments, the motor used in the adjustable clasp may be a worm-gear motor, a lead screw actuator, or a rack and pinion motor; the sensors may be touch sensors, pressure sensors, or a combination thereof. A user may provide instructions related to the operation of the clasp to the control unit via a user input unit.

The clasp may comprise a second motor disposed on the clasp to provide an additional adjustment. Furthermore, the clasp may comprise a magnet shield on certain surfaces or parts of the clasp members to insulate the areas outside the magnetic pieces from magnetic force.

According to another embodiment, the present invention provides a wearable band having any type of clasp equipped with the motor for band length adjustment. The wearable band comprises a flexible elongated band having two end portions, a clasp attached to the two end portions of the flexible elongated band for opening and closing the wearable band. The wearable band may further comprise a motor disposed on the clasp. The wearable band may further comprise sensors and a control unit. The sensors acquire information related to the wearable band and send sensed or acquired information to the first control unit, which may send triggering signals to the motor in order to activate or deactivate the motor based on the sensed information. The movement of the motor changes the relative position of the clasp with respect to flexible elongated band, thereby fine tuning the tightening or loosening of the wearable band.

In a preferred embodiment, the flexible elongated band encloses a shape memory material. This may be in wire, string, bead or any other formats such as nano-tubules or nano-3D ink printed formulations. Because the shape memory material transitions between a memorized shape and a temporary shape of the shape memory material upon receipt of a stimulus, the flexible elongated band may deform and self-assemble around a body part when a stimulus is applied to the shape memory material. In this preferred embodiment, the wearable band also comprises a trigger source which is configured to provide a stimulus to the shape memory material. A preferred memory shape material is Nitinol in the form of thin wires. The electronic parts, such as battery and control unit, may be housed in the clasp itself, in a link of a multiple solid linked band or in a watch, or other device, or other body including but not limited to jewelry, that is coupled to the band.

According to a further embodiment, the present invention provides a wearable band having an automatically adjustable magnetic clasp with the motor. The wearable band comprises a flexible elongated band having two end portions and a magnetic clasp having a first and a second clasp members attached to the two end portions of the elongated band. The first clasp member has a first magnet piece, and the second clasp member has a second magnet piece. The two end portions of the band are separated from one another in an open position of the band and attract and magnetically connect to each other to form an overlap in a closed position of the band. The wearable band may further comprise a motor disposed on one of the clasp members. The wearable band may further comprise sensors and a control unit. The sensors acquire information related to the wearable band and send sensed or acquired information to the first control unit. The first control unit may send triggering signals to the motor in order to activate or deactivate the motor based on the sensed information. The movement of the motor changes the relative position of the magnetic clasp with respect to flexible elongated band, thereby fine tuning the tightening or loosening of the wearable band.

Preferably, a shape memory material is enclosed in the flexible elongated band so that the flexible elongated band may self-assemble around a body part when a stimulus is applied to the shape memory material. The self-assembly will bring the two end portions (where the two magnet pieces reside) together so that the two end portions can automatically clasp by the magnetic force between them. As a result, the entire closing and tightening process can be essentially hand-free. For instance, when the wearable band is coupled to a watch having touch sensors (or pressure sensors) on the back surface of the watch or on the interior surface and side surface of the band, upon laying the watch on a person's wrist, the touch sensors send signals to the control unit, which in turn communicates with a battery (trigger source) housed in a buckle of the clasp or band, watch or other device or body of the wearable and instructs the battery to supply electrical current to apply to the memory shape material, causing the two end portions of the elongated band to bend and approach one another and the two magnet pieces on the two end portions to clasp. Subsequent tensioning of the strap after clasp closure and maintenance of the tightness of the strap during wearing can be automatically accomplished by the control unit which may activate, as discussed before.

The stimulus can be also triggered by a user input which communicatively connects to the trigger source. The user input unit may be in the form of a switch, a knob, a push button, a touch screen (e.g., as found on a smart phone or computer), or a voice activated control (e.g., Siri) attached directly to or incorporated in any portion or location of the assembly or wearable.

Furthermore, the control unit may communicatively connect to the user input unit, wherein the control unit receives instructions from the user input unit and controls the phase transition of the shape memory material and the activation of the motor based on the instructions. A user may enter the instructions through the touch screen of a smart watch attached to the band. The instructions can also be programmed remotely and then be received by the clasp/band assembly user input unit thru a smart phone, computer or other device using Bluetooth or other communication methods.

DETAILED DESCRIPTION OF THE INVENTION

Figure 1A:
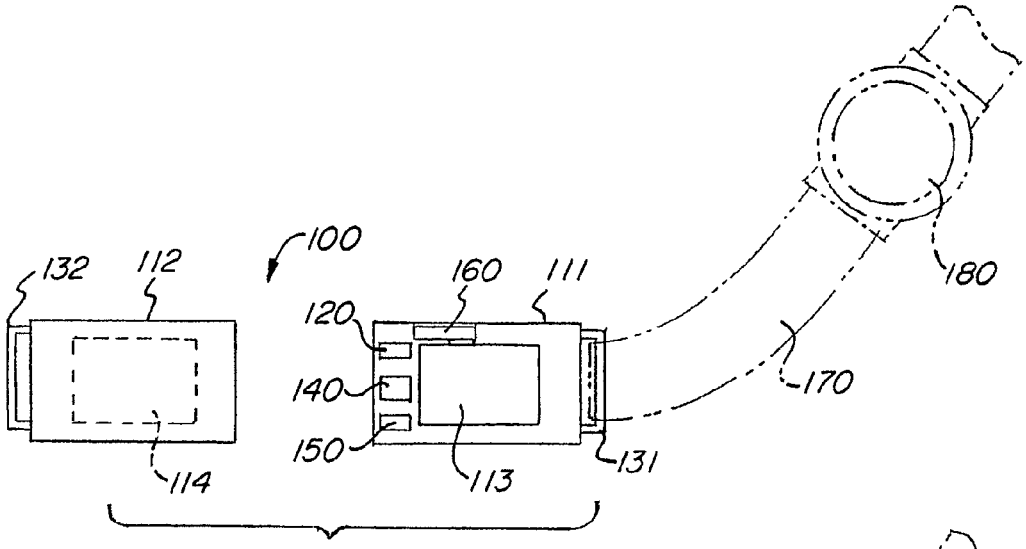
FIGS. 1A and 1B show isometric, schematic views of an embodiment of an adjustable magnetic clasp in an open position and a closed position.
Figure 1B:
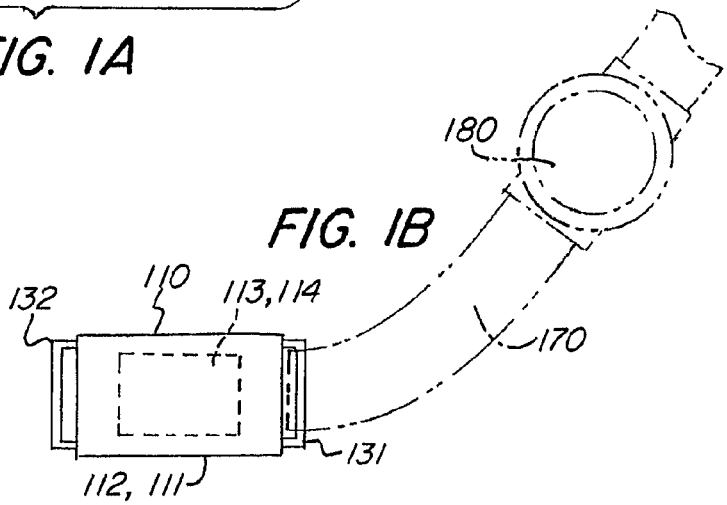
Figure 2A:
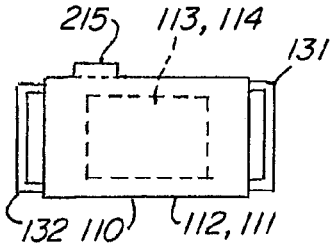
FIGS. 2A, 2B, 2C, and 2D show enlarged isometric views of embodiments of a magnetic clasp in its closed position.
Figure 2C:
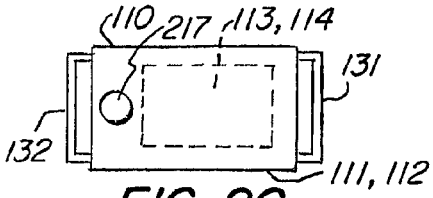
Figure 2B:
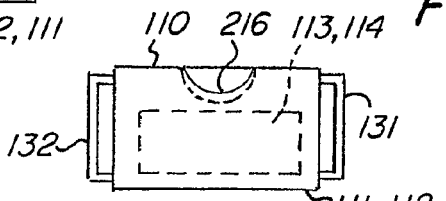
Figure 2D:
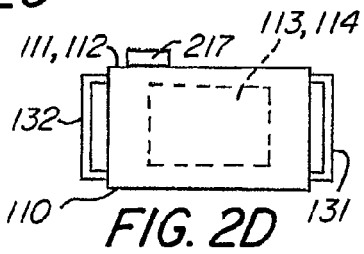

FIGS. 1A and 1B show a self-adjusting clasp 100 according to a first embodiment of the invention. The self-adjusting clasp 100 comprises a first clasp member 111 having a first magnet piece 113 and a second clasp member 112 having a second magnet piece 114. The first and the second clasp members 111,112 are separable from one another in an open position of the clasp 100, as illustrated in FIG. 1A. The first and the second clasp members 111,112 mutually attract and magnetically connect to each other to form an overlap 110 in a closed position of the clasp 100, as illustrated in FIG. 1B. The self-adjusting clasp 100 further comprises a motor 120 disposed on one of the clasp members (e.g., the clasp member 111) and anchor mechanisms 131,132 coupled to each of the clasp members 111, 112 for attaching the clasp 100 to a band 170 (shown in phantom in FIGS. 1A and 1B). The motor 120 is configured to adjust the position of the anchor mechanism 131 with respect to the rest of the clasp 100. The clasp 100 may also comprise one or more sensors 140 and a control unit 150 which is in communication with the sensors 140 and the motor 120. The sensors 140 are configured to acquire information related to the clasp 100 or the band 170 and send sensed or acquired information (e.g., measurements) to the control unit 150. The control unit 150 is configured to send triggering signals to the motor 120 in order to activate or deactivate the motor 120 based on the sensed information. The movement of the motor 120 changes the relative position of the anchor mechanism 131 with respect to the rest of the clasp 100, thereby loosening or tightening of the band 170 attached to the anchor mechanism 131.

By using the sensors 140 to acquire information and further trigger the activation and/or deactivation of the motor 120 for adjusting the relative position of the anchor mechanism 131 with respect to the rest of the clasp 100, as needed, the present invention provides an automatically adjustable and/or automatically fitting clasp.

The magnet pieces 113,114 may be permanent magnets made of neodymium-iron-boron. By way of example, FIGS. 1A and 1B show that the magnet pieces 113,114 take the form of small rectangular plates arranged in the thickness of the clasp members 111,112. However, the magnet pieces may be of any suitable shapes. Since the magnetic force of attraction decreases with distance, this force is exerted most between the first and second magnet pieces 113,114 when they are directly and substantially superposed on each other. Accordingly, not only the two magnet pieces 113,114 should be matched magnets (namely, they are polarized in the same direction) so that they can be superposed on each other, the two magnet pieces 113,114 also, preferably, have substantially the same size and same shape to maximize the exertion of magnetic force. The magnetic force between the magnet pieces 113,114 causes the clasp members 111,112 to adhere strongly to each other.

Those skilled in the art will understand that the mutually attracting magnetic pieces described previously could be electromagnetic fields or any other force types that can mutually attract and lock together.

FIGS. 2A, 2B, 2C, and 2D illustrate some embodiments of the overlap 110 of the clasp members 111,112. The overlap 110 may have a tab 215, an indentation 216, or a button 217 on an edge of the clasp members 111,112 so that a user may easily lift up or push away one of the clasp members with a finger in order to open the engaged clasp members 111,112. A skilled artisan will understand that there are other mechanisms known in the art, such as an automatic mechanism with a remotely controlled motor, may be used to separate two attracted magnet pieces. Since the magnetic force of attraction decreases with distance, only an initial force is needed to break the attraction between the two magnet pieces. One advantage of the magnetic clasp in accordance with the present invention is that it can be easily operated (i.e., open and closed) with a single hand or hands free.

Referring back to FIGS. 1A and 1B, the clasp 100 comprises one or more sensors 140 for determining when the band 170 should be further tightened or loosened. While one sensor may be used, for ease of discussion, reference to sensors in the plural form is made below. Moreover, more than one type of sensors may be used. The sensors may be configured such that the number, configuration, or pattern of the sensors in contact with an object will determine the timing for closing the clasp and tensioning of the clasp.

The sensors 140 may be placed in the clasp 100 (as shown in FIG. 1A), the band 170, and/or an article 180 attached to the band 170 (shown in phantom in FIGS. 1A and 1B). The article 180 may include, but is not limited to a watch, a jewelry, a heart rate monitor, an exercise monitor (e.g., Fitbit monitor), etc. Preferably, the sensors 140 are placed close to or on the interior surfaces of the clasp 100, the band 170, and/or the article 180, which will be in contact with a body part during wearing, so that the sensors 140 will be close to or in contact with the body part to acquire more accurate information. However, there are embodiments where the sensors 140 are distributed evenly on the interior and side surfaces of the band 170. Examples of the sensors 140 that may be used include, but are not limited to, at least one of pressure sensors, capacitive sensors, conductivity sensors, light sensors, touch sensors, heat sensors, strain gauges stress gauges, and bend sensors. In some embodiments, the sensors are pressure sensors which measure at least one of pressure, stress or strain of the elongated band 170 on an object wearing the band. In other embodiments, the sensors are touch sensors which provide information about physical contact between a band 170 and a body part.

The sensors 140 may electronically communicate with the control unit 150 to send sensed information (e.g., measurements) to the control unit 150. Based on the information received from the sensors 140, the control unit 150 may determine whether the motor 120 needs to be activated to loosen or tighten the band 170, and if so, the particular movement to be carried out by the motor 120 to reach the desired effect. The control unit 150 then sends triggering signals to the motors 120 to activate that movement. For example, if the measurements from the sensors 140 indicate that the band 170 is too loose, as compared to a threshold value, the control unit 150 may activate the motor 120 in order to tighten the band 170; conversely, if the measurements from the sensors 140 indicate that the band 170 is too tight, as compared to a threshold value, the control unit 150 may activate the motor 120 in order to loosen the band 170. This process may also be characterized as a sensor triggered activation. When a threshold tightness level is reached after the motor movement and detected by the sensors 140, the sensors 140 will communicate with the control unit 150, which triggers the motors 120 to stop its movement. In some embodiments, the control unit 150 may be a central processing unit (CPU). In other embodiments, the control unit 150 may be a simple circuit for receiving inputs and providing an output according to the inputs to motors 120.

The control unit 150 may be disposed in many places. In some embodiments, the control unit 150 may be disposed distantly away from the clasp. In other embodiments, the control unit 150 may be disposed in the belt, the buckle of the belt, or the article (e.g., smart watches) attached to the belt. In a preferred embodiment, the control unit 150 may be disposed in the clasp 100.

Figure 3:
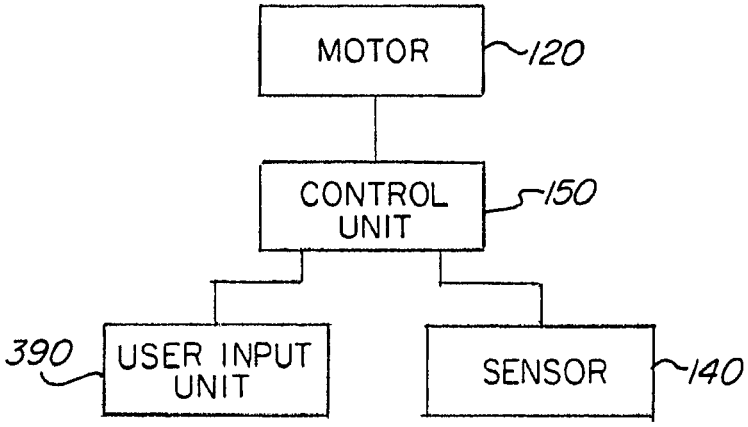
FIG. 3 shows a schematic view of an embodiment having a different mechanism to activate a motor according to the embodiment.

In addition to the sensor triggered activation, activation of the motor 120 may be triggered by a user input. This process may also be called a user triggered activation. FIG. 3 is a block diagram showing the two types of activation mechanisms. In this diagram, the control unit 150 communicates with the sensors 140, which may trigger activation of the motor 120 through the control unit 150. At the same time, the control unit 150 also communicates with a user input unit 390. Upon receiving a triggering signal from the user input unit 390, the control unit 150 activates the motor 120 in accordance with the user input. The user input unit 390 may be a push button that can be pushed to activate the motor 120. The user input unit 390 may also be an interface on a computer, a handheld remote control, or on a smart watch which allows a user to manually provide instructions. A user may also set or change a threshold tightness level before or during wearing of the band by using the interface. The present invention advantageously allows for setting different tightness for different people as some people may not want a band to be in full contact with their skin but would rather have some degree of slack in the final fit.

If the activation of the motor 120 is only triggered by the sensors 140, then the adjustment is completely automatic. The activation of the motor 120 may be triggered by the sensors 140 and a user consecutively. The control unit 150 is configured that, if the control unit 150 receives information from the user input 390 and the sensors 140 simultaneously, the information from the user input 390 controls.

Those skilled in the art understand that the control unit contains additional controls as necessary to work the invention correctly. An example of one such control would be an alarm/notification, automatic conversion to manual control, or automatic release of the tightness of the clasp/band assembly for safety purposes if the sensors determine it is tightened beyond safe parameters programmed into the control unit.

As discussed previously, the motor 120 is disposed in one clasp member 111 of the clasp 100, to which the anchor mechanism 131 is attached. The movement of the motor 120 adjusts the position of the anchor mechanism 131 with respect to the rest of the clasp 100. However, the adjustment is on a small scale. In some embodiments, the relative position between the anchor mechanism 131 and the rest of the clasp 100 is increased or decreased only by approximately +/−6 mm, with a total travel distance of 12 mm, as a result of the motor movement. Therefore, the adjustment may also be referred as tensioning or fine tuning.

Motors suitable for use in the present invention may be any type, including, but not limited to, an electric motor, an electrostatic motor, a pneumatic motor, a hydraulic motor, a fuel powered motor. In a preferred embodiment, the motor is an electric motor that transforms electrical energy into mechanical energy. Additionally, the motor needs to be small enough to be housed in a clasp member. It is also preferred that the motor can complete the tensioning or fine tuning quickly upon receiving instructional triggering signals. For examples, in some embodiments, it takes the motor 120 as short as 1-2 seconds to increase or decrease a relative position by approximately +/−6 mm.

Figure 4A:
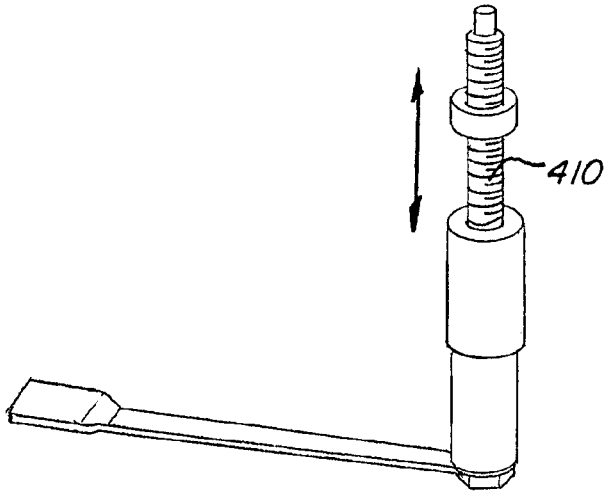
FIGS. 4A, 4B, and 4C show enlarged isometric, schematic views of embodiments of different motors suitable for use in the embodiment.
Figure 4B:
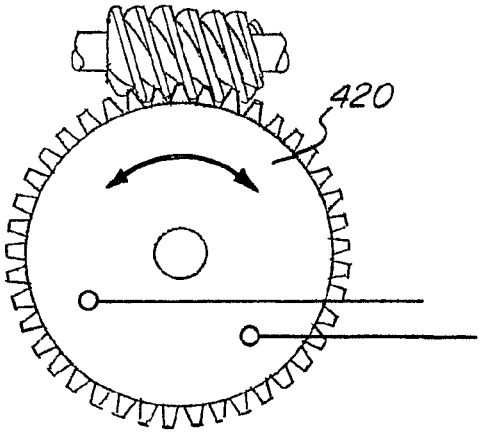
Figure 4C:
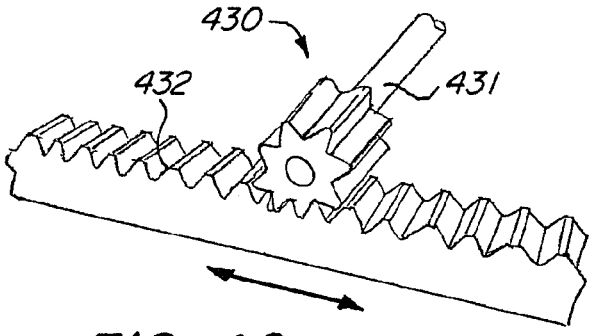

FIGS. 4A, 4B, and 4C illustrate a few commonly known electric motors that may be used in the present invention. In some embodiments, the motor 120 may be a lead screw actuator 410 (FIG. 4A). In other embodiments, the motor 120 may be a worm-gear type motor 420 (FIG. 4B). In additional embodiments, the motor 120 may be a rack and pinion motor 430 (FIG. 4C). A skilled artisan will understand that the mechanisms of the electric motors in adjusting the relative position of the anchor mechanism 131 with respect to the rest of the clasp 100. For example, the motor 430 comprises a driveshaft 431 and a longitudinal gear 432 (FIG. 4C). When the motor 120 causes the driveshaft 431 to rotate in a counterclockwise direction with respect to the longitudinal gear 432, more gear teeth will be available in the right direction, as marked in FIG. 4C. Conversely, if the motor 120 causes the driveshaft 431 to rotate in a clockwise direction with respect to the longitudinal gear 432, less gear teeth will be available in the right direction. The amount of the gear teeth available in one direction (verses the other direction) determines the relative position between the clasp member 111 and the anchor mechanisms 131, 132. Thus, by turning the driveshaft 431 in a counterclockwise direction or a clockwise direction, the motor adjusts the flexible elongated band between a tightened position and a loosened position.

The clasp 100 may further comprise at least one power source to supply power to the motor 120, and optionally also supply power to the control unit 150 and the sensors 140. In some embodiments, the motor 120 may be associated with an external battery 160, as shown in FIG. 1A. In preferred embodiments, the motor 120 may include an internal battery (not shown). An external battery may also be housed in a buckle of the band or a smart watch. The battery may be any type, shape, or form of battery. It may be a disposable battery or a rechargeable battery. The control unit contains a program to notify the user of need to replace a disposable battery or to charge the rechargeable battery.

Figure 5:
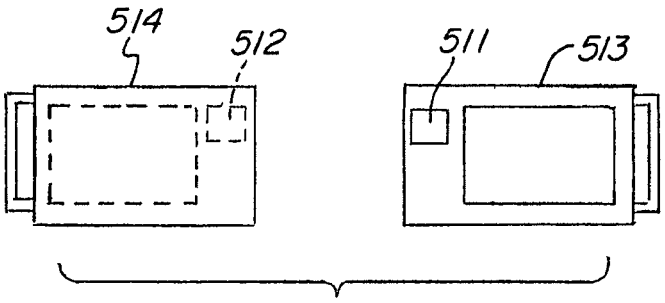
FIG. 5 show an enlarged schematic view of an embodiment of a magnetic clasp having two motors.

While FIGS. 1A and 1B show an example of a single clasp member 111 housing many components (e.g., a motor, a control unit, a battery, and sensors), a skilled artisan will understand that those components may be housed in both clasp members 111,112. Moreover, as discussed earlier, a control unit and sensors may be placed externally from the clasp. Moreover, a skilled artisan will understand that the present invention also encompasses a magnetic clasp having two motors 511,512, one on each of the clasp members 513,514, to separately provide the tensioning. These embodiments are illustrated in FIGS. 5A and 5B. The two motors may share one control unit or have their own control units. A clasp having two motors are called dual actuation clasp, while a clasp having a single motor is called single actuation clasp.

Figure 6:
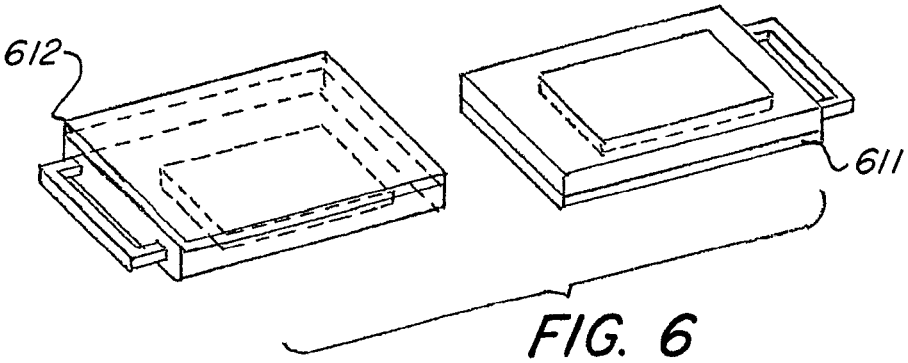
FIG. 6 show an enlarged prospective, schematic view of an embodiment of a magnetic clasp having magnet shields.

Referring to FIG. 6, the clasp members 111,112 may have removable or fixed magnet shields 611,612 coupled to the surfaces of the clasp members 111,112. The magnet shields 611,612 are configured to keep the areas outside the clasp 100 free from a magnet force while allowing the magnet pieces 113,114 to adhere to each other by magnetic force. In a preferred embodiment, the shields are made of Mu shielding material.

Figure 7B:
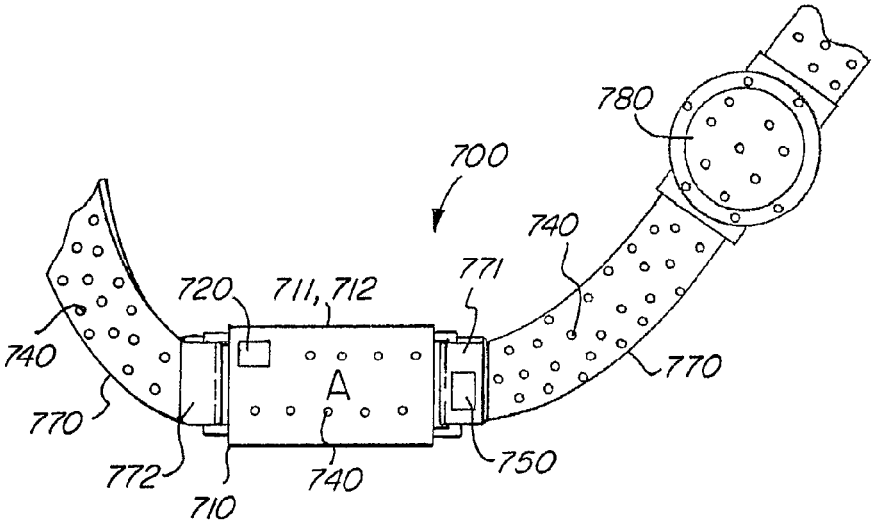
FIGS. 7A and 7B show isometric, schematic views of an embodiment of a wearable band having an adjustable clasp in an open position and a closed position.
Figure 7A:
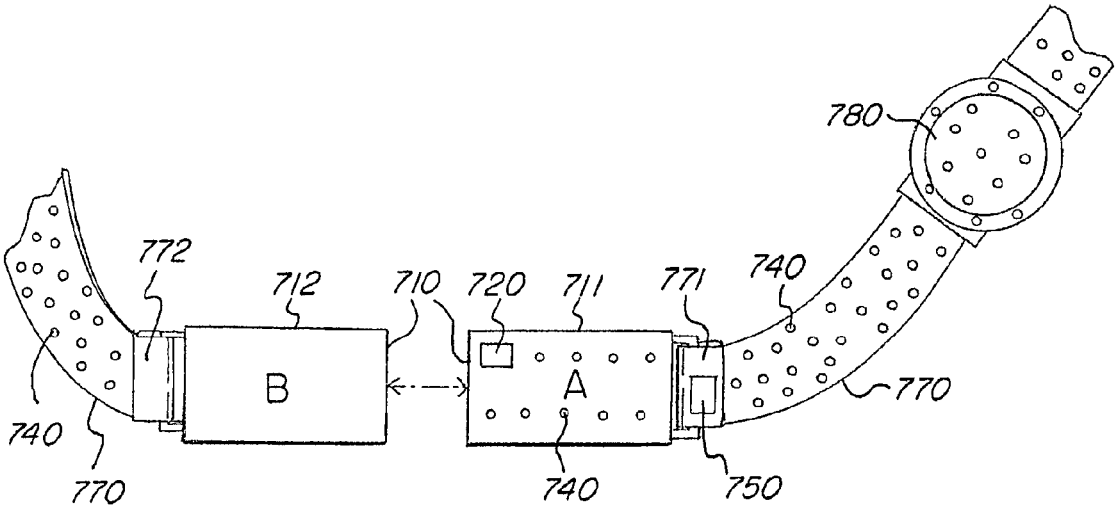

FIGS. 7A and 7B show a wearable band having a self-adjusting clasp 700 in its open and closed positions, respectively, according to another embodiment of the invention. The wearable band 700 comprises a flexible elongated band 770 having two end portions 771,772, a clasp 710 having two clasp members 711,712 attached to the two end portions 771,772 of the flexible elongated band 770 for opening and closing the wearable band 700. The wearable band 700 may further comprise a motor 720 disposed on one of the clasp members (e.g., 711). The wearable band 700 may further comprise first set of sensors 740 and a first control unit 750 which is in communication with the first set of sensors 740 and the motor 720. The first set of sensors 740 are configured to acquire information related to the wearable band 700 and send sensed or acquired information (e.g., measurements) to the first control unit 750. The first control unit 750 is configured to send triggering signals to the motor 720 in order to activate or deactivate the motor 720 based on the sensed information. The movement of the motor 720 changes the relative position of the clasp 710 with respect to flexible elongated band 770, thereby fine tuning the tightening or loosening the wearable band 700.

By using sensors to acquire information and trigger the activation and/or deactivation of the motor in order to fine tune the length of the wearable band as needed, the present invention advantageously provides a wearable band with a clasp that can automatically adjust and substantially maintain a preferred tightness of the strap during wearing. The wearable band 700 may be attached to an article 780, such as a watch, jewelry, a heart rate monitor, or a fitness monitor (e.g., a Fitbit Tracker). The wearable band of the present invention can hold up well to physical exercise, fitness activities and sports.

The motor 720 is substantially similar to the motor 120 described previously with respect to FIGS. 1A, 1B, 4A, 4B, 4C, 5A, and 5B. Therefore, the details of the motor 720 will not be repeated here. The motor 720 is disposed in a clasp member 711 of the clasp 710, wherein the clasp 710 is further coupled to flexible elongated band 770. The movement of the motor 720 adjusts the position of the clasp with respect to the band, thereby extending or shortening the band length. In addition to being housed in a clasp member of the clasp, the motor 720 may also be placed at other locations of the band 700. Like the motor 120, the motor 720 may also include an external battery or an internal battery.

The first set of sensors 740 for triggering activation as well as deactivation of the motor 720 is substantially similar to the sensors 140 described previously with respect to FIGS. 1A and 1B. Therefore, the details of the first set of sensors 740 will not be repeated here. The first set of sensors 740 may be dispersed on the interior and side surfaces of the clasp 710, the flexible elongated band 770, and/or the article 700. In some embodiments, the first set of sensors 740 may be dispersed on the back of a watch. In preferred embodiments, the first set of sensors 740 are dispersed close to or onto the interior and side surface of the flexible elongated band 770. Moreover, the first set of the sensors 740 may be configured such that the number, configuration, or pattern of the sensors in contact with an object will determine the timing for closing the band and tensioning of the band.

Since the first control unit 750 is substantially similar to the control unit 150 described previously with respect to FIGS. 1A, 1B, and 3, the detailed information of the first control unit 750 will not be repeated here. Like the control unit 150, the first control unit 750 may also receive information or instructions from first set of sensors 740 and/or from a user manual input, and subsequently control the movement of the motor 720 based on such information or instructions.

The clasp 710 may be any type of clasp suitable for use with an elongated belt or band. At least one of the clasp members 711,712, however, should be sufficiently large to house the motor 720.

The flexible elongated belt or band 770 may be made of, for example, leather, faux leather, metal such as stainless steel, ceramics, or nylon. It may be composed of a single elongated solid piece (e.g., a leather strap) or multiple solid links. When the band 770 is composed of multiple solid links, some links may be removed or added to shorten or extend the length of the band to create a customized band length. The technique to remove or add links to a band is well known in the art. When the band 770 is composed of a single elongated solid piece, an extra piece may be pulled over to form an overlap or the extra piece may be cut to keep the band fit on a body part with desired tightness. Additionally, a buckle may be attached to the band 770 either by cutting and anchoring or by bolting onto the band 770 (similar to the Montblanc™ clasp attachment). The buckle may house sensors, battery, and/or motor i.e. the entire clasp mechanism can be housed in such a separate buckle or other attachable piece such as the Montblanc™ clasp attachment. Additionally, the electronic parts may be housed in a link of a multiple solid linked band, in portions of a soft band, or in a watch or other device that is coupled to the band. The electrical and control connections are modified accordingly and will be evident to those skilled in the art.

As described previously, the interior and side surface of the flexible elongated band 770 may include the first set of sensors 740 which is in communication with the first control unit 750. When the band is worn by a user, the first set of sensors 740 are in close contact with the body part and acquire information related to the band and the body part. The first set of sensors 740 then send the information to the first control unit 750, which may trigger the motor 720 to loosen or tighten the length of the band 770.

FIGS. 8, 9A, 9B, 9C, and 9D, collectively, represent a preferred embodiment of the present invention in which the flexible elongated band 770 encloses a shape memory material (SMM) 810. In this embodiment, the wearable band 700 also comprises a trigger source 820 which is configured to communicate with and further provide a stimulus to the shape memory material 810.

Shape memory is a physical phenomenon by which a plastically deformed material is restored to its original shape by a solid state phase change caused by a stimulus. Shape memory material may be used in the art of self-assembling of shape memory material around an underlying object in response to a stimulus and provides adaptive shape adjustment based on the shape of the underlying object and on the amount of force and/or pressure exerted on the underlying object. It may also be used in connection with 4-D printing. The inventor of the present application has a pending application, U.S. patent application Ser. No. 14/611,807, filed Feb. 2, 2015, which is entitled "Hybrid Smart Assembling 4D Material" directed to the subject of using a hybrid shape memory material in such application.

Figure 9A:
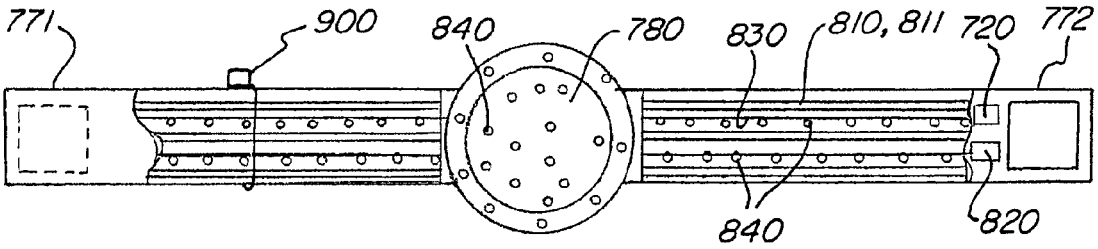
FIGS. 9A and 9B show an enlarged cross-sectional view and an isometric view of an embodiment of a wearable band having an adjustable clasp in its open position with parts removed to review internal details.
Figure 9B:
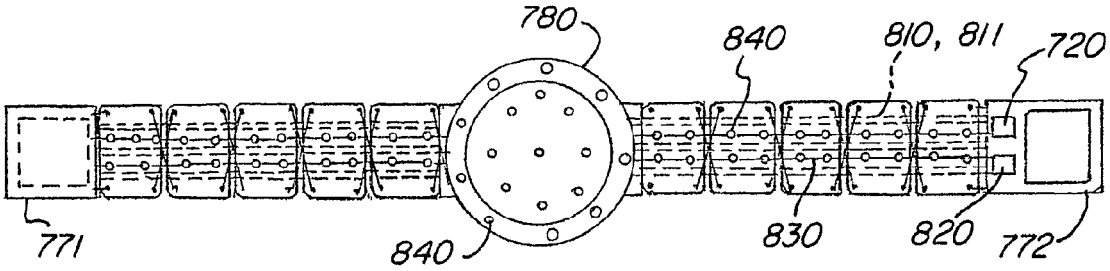
Figure 9C:
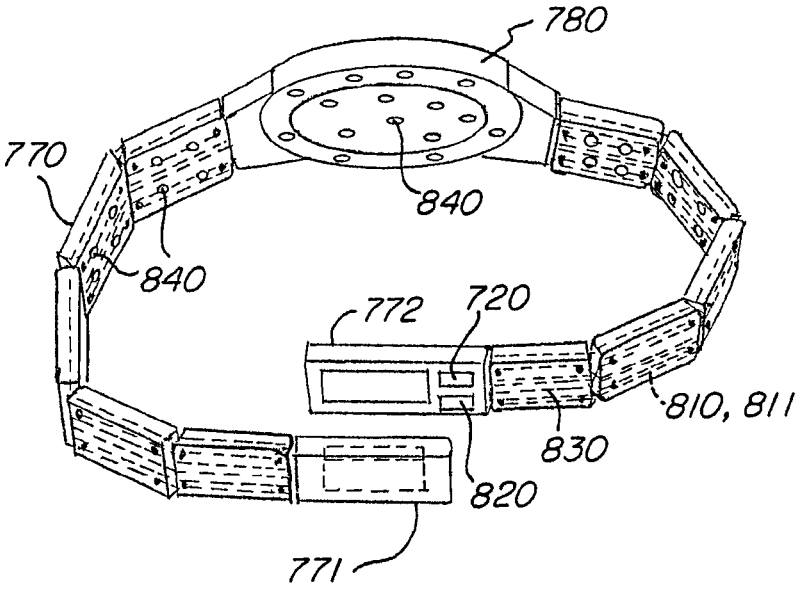
FIGS. 9C and 9D show an isometric view and an enlarged cross-sectional view of an embodiment of a wearable band having an adjustable clasp being deformed and being clasped, respectively, with parts removed to review internal details.

In this case, the shape memory material 810 is configured to transition between a memorized shape and a temporary shape upon receipt of a stimulus. FIG. 9A represents a lateral cross-sectional view of the flexible elongated band 770 having a shape memory material 810. Upon receiving a stimulus, the shape memory material 810 may transform to their original form (a more stable form) and cause the flexible elongated band 770 to bend and its two end portions 771,772 to move toward each other (and would wrap around a body part if present, also called "self-assembly"), as shown in FIG. 9C. In a preferred embodiment, nitinol wires are used as the shape memory material. The nitinol wires, upon stimulation, will deform primarily in radius which creates both a tension and pressure type of adjustment. In one embodiment, the nitinol wires contracts by about 4% to about 5% at 80° C. Noticeable changes include the change of the band length and the curving effect of the band. Therefore, the phase transition of the shape memory material 810 advantageously provides a separate tensioning of the band in addition to the tensioning by the motor 720. One advantage of this embodiment is that both the band and the clasp are independently self-adjustable.

The shape memory material 810 of the present invention may comprise at least one of a shape memory polymer or shape memory alloy. In one embodiment, the shape memory material 810 comprises a hybrid of a shape memory polymer or shape memory alloy. In a preferred embodiment, the shape memory material 810 consists of a shape memory metal alloy 811. One commonly known shape memory metal alloy is Nitinol. Nitinol is the generic name for a shape memory metallic alloy composed primarily of nickel and titanium, with small or trace amounts of iron, copper, zinc, aluminum, oxygen, hydrogen, nitrogen or other elements. Nitinol comprises from approximately 50 to 60 wt percent Ni and approximately 40 to 50 wt percent Ti. Other shape memory alloys, which may also be used in the present invention, include combinations of copper-aluminum-nickel, gold-cadmium, copper-zinc aluminum, silver cadmium, silver-zinc, copper-aluminum and copper-zinc.

Figure 9D:
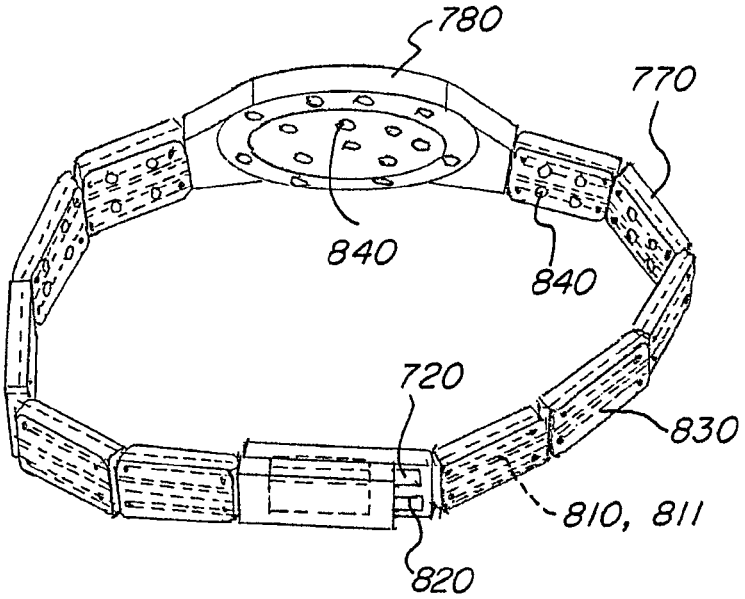

The shape memory metal alloy may be enclosed in the elongated band 770 in form of wires, rods, or braided, stranded or bundled cables. A preferred configuration for the shape memory metal alloy 811 is a relatively thin wire, preferably about 15 mm (or about 0.006 inch) in diameter, but which may be larger or smaller if desired. According to some embodiments as shown in FIGS. 9B, 9C and 9D, the elongated band 770 is composed of multiple solid links. A number of shape memory alloy wires 811 and electric wires 830, typically two to six shape memory alloy wires, are disposed in parallel in the flexible elongated band 770 across all the solid links. The electric wires 830 are in communication with the control unit and are able to provide electric current stimulus. In some embodiments, the lengths of the wires 811 are substantially equal to the length of the elongated band 770, which is the sum of all the solid links.

Conventionally, the links are connected by using pins. To adjust the length of the band, one may detach the solid links from a buckle of the band, remove one or two links from the band, based on need. Typically, the one or two links are those positioned next to the clasp. At the same time, one may cut any extra portion of the shape memory alloy or electrical wiring so they accommodate the new length or size of the band or belt, and reattach them to the terminal blocks in the, clasp, buckle or the link of the wearable band.

There are multiple ways that the solid links may be connected in forming the band of the present invention to maintain the connections of the nitinol and electrical wiring, even if it is 3D nanotech ink printed. For instance, the ends of the links where the links are in touch for connection may have copper or other electrodes such that there is a conducting connection between the links. The contact may provide an electric stimulus to Nitinol wires that run through the links. This configuration does not require a terminal block on the clasp or buckle for reattaching cut wire in link removal for sizing. The connecting electrodes can be curved or configured to maintain contact thru an arc of motion to allow the hinged links to close or open as the band self assembles or de-assembles around an object.

Referring back to FIG. 8, the trigger source 820 is in communication with the shape memory material 810 and a second control unit 850. The second control unit 850 communicatively connected to second set of sensors 840, wherein the second control unit 850 controls the phase transition of the memory shape material based on measurements provided by the second set of sensors 840, wherein during self-assembly, the second control unit instructs the trigger source 820 to continue applying the first trigger to the shape memory material until a pre-determined value is detected by the sensor, at which point the second control unit 850 instructs the trigger source 820 to apply the second trigger.

The trigger source 820 is also in communication with the shape memory material 810 as well as with a user input unit 890. According to instructions from the user input unit 890, the trigger source 820 may generate a stimulus to the shape memory material 810. The user input unit 890 may be in the form of, for example, a switch, a knob, a push button, or a touch screen. In one embodiment, the user input 890 is a push button 900 located on a belt buckle or on a belt, as shown in FIG. 9A. After the push button 900 is pushed, the trigger source 820 creates and applies a stimulus (e.g., electric circuit) to the shape memory material 810, causing the shape memory material 810 to deform, and the two end portions of the elongated band to bend and approach one another, as shown in FIG. 9C. In other embodiments, the user input unit 890 is an interface on a computer, a handheld remote control device, or a smart watch, in which case, the trigger source 820 may receive instructions directly from the touch screen of a computer, a handheld remote control device, or a smart watch. The user input unit 890 may also allow a user to set threshold levels of various sensors. It may further allow a user to select the types and locates of various sensors dispersed on the band, buckle, clasp, and/or article.

Examples of the second set of sensors 840 that may be used include, but are not limited to at least one of pressure sensors, capacitive sensors, conductivity sensors, light sensors, touch sensors, heat sensors, strain gauges stress gauges, and bend sensors. The second set of sensors 840 are preferably located on the interior surfaces of the band 770, and/or an article 780 (e.g., watch, jewelry, heart rate monitor) attached to the band 770. In some embodiments, the sensors are touch sensors to sense whether the band contacts the object or not. Preferably, the touch sensors are dispersed on the back of a watch and/or the links of the band, either on the interior surface or on the side of the band, close to the watch so that upon putting the watch on a wrist, the touch sensors immediately detect the contact with the wrist.

The stimulus may comprise one or more of: application of electric current; application of electromagnetic radiation at a specific wavelength; application of light; application of touch-pressure, a change in temperature (e.g., the temperature change being produced by using body heat); and a change in moisture level (i.e., the moisture level change being produced by body sweat). In a preferred embodiment, the stimulus is application of electric current. To clearly illustrate the embodiments of the present invention, electric current is taken as an example of the stimulus in the following description, but the disclosure is not limited thereto. The trigger source 820 applies electric current to the shape memory metal alloy 811, which causes the shape memory alloy 811 to heat up because of the current inputted continuously. When the temperature of the shape memory alloy 811 reaches a phase transition temperature, the shape memory alloy 811 may return back to its original shape, causing the flexible elongated band 770 to bend and its two end portions 771,772 moving toward each other and later clasp as shown in FIGS. 9C and 9D, respectively.

Figure 8:
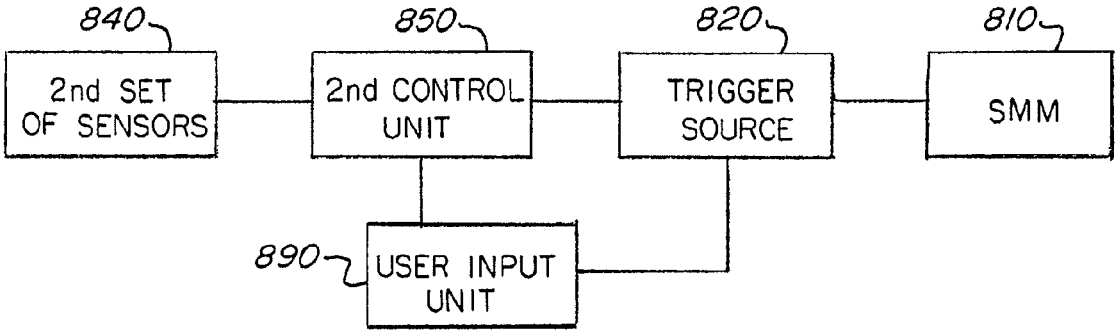
FIG. 8 shows a schematic view of an embodiment having a different mechanism to stimulate a shape memory material according to the embodiment.

According to some embodiments, the phase transition activation mechanism disclosed in FIG. 8 and the motor activation mechanism disclosed in FIG. 3 may share the same user input and sensors. In other words, only one set of sensors are required to serve as the first set of sensors 740 (to trigger the activation of the motor 720) and as the second set of sensors 840 (to trigger the phase transition of the shape memory material 810). A user may use a single device, such as the touch screen of a smart watch to input instructions to the first control unit and to the trigger source. Moreover, one single control unit may be used to control the activation of the motor 720 and the shape memory transition.

Figure 10A:
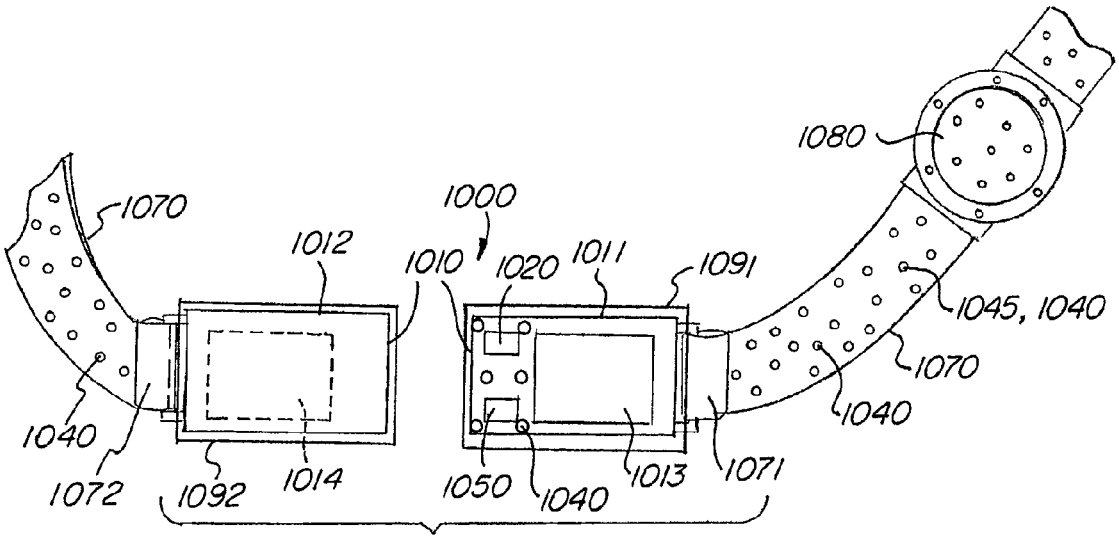
FIGS. 10A and 10B show isometric, schematic views of an embodiment of a wearable band having an adjustable magnetic clasp in an open position and a closed position.
Figure 10B:
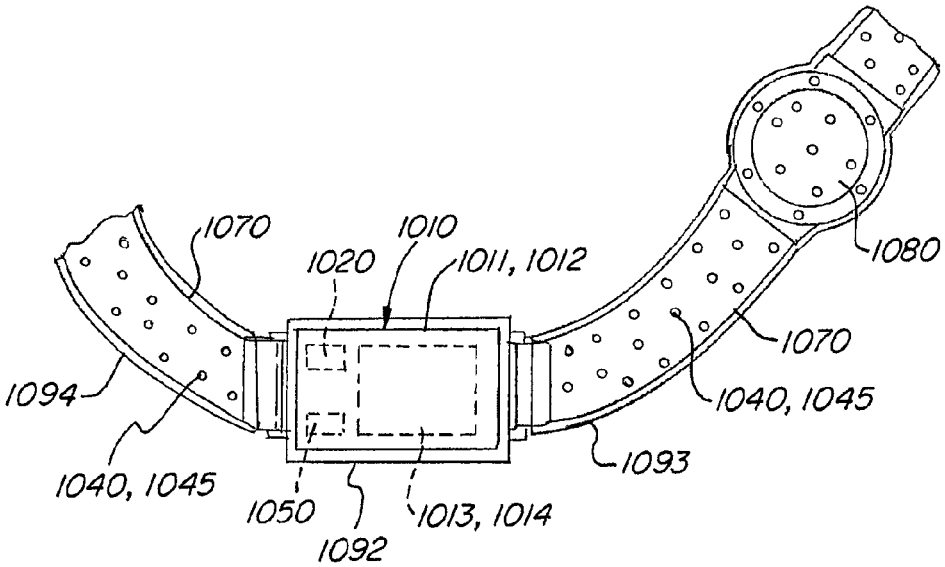

FIGS. 10A and 10B show a wearable band having a self-adjusting magnetic clasp 1000 in its open and closed positions, respectively, according to another embodiment of the present invention.

The wearable band 1000 comprises a flexible elongated band 1070 having two end portions 1071,1072, and a magnetic clasp 1010 having a first and a second clasp members 1011,1012 attached to the two end portions 1071, 1072. The first clasp member 1011 has a first magnet piece 1013, and the second clasp member 1012 has a second magnet piece 1014. The two end portions 1071,1072 of the band 1000 are separable from one another in an open position of the band 1000 and are configured to mutually attract and magnetically connect to each other to form an overlap in a closed position of the band 1000. The wearable band 1000 may further comprise a motor 1020 disposed on one of the clasp members (e.g., 1011). The wearable band 1000 may further comprise first set of sensors 1040 to detect information related to the wearable band 1000 and a first control unit 1050 which is in communication with the first set of sensors 1040 and the motor 1020. The first set of sensors 1040 are configured to acquire information and send sensed or acquired information (e.g., measurements) to the first control unit 1050. The first control unit 1050 is configured to send triggering signals to the motor 1020 in order to activate or deactivate the motor 1020 based on the sensed information. The movement of the motor 1020 changes the relative position of the magnetic clasp 1010 with respect to flexible elongated band 1070, thereby fine tuning the tightening or loosening the wearable band 1000.

Since most of the components (i.e., the motor 1020, the first set of sensors 1040, the first control unit 1050, the magnetic clasp 1010, and the flexible elongated band 1070) of the wearable band 1000 are similar to those of the wearable band 700 and the magnetic clasp 100, the detailed information of the wearable band 1000 will not be repeated here.

As noted before, FIGS. 10A and 10B show an example of a single clasp member 1011 housing many components (e.g., a motor, a control unit, and sensors), a skilled artisan will understand that these components may be housed in both clasp members 1011,1012. Moreover, as discussed earlier, a control unit and sensors may be placed externally from the magnetic clasp. Moreover, a skilled artisan will understand that the present invention also encompasses a magnetic clasp having one or two motors, one on each of the clasp members, to separately provide double tensioning actions. The two motors may share one control unit or have their own control units.

Referring to FIGS. 10A and 10B, the clasp members 1011,1012 may further have removable or fixed magnet shields 1091,1092 coupled to the surfaces of the two clasp members 1011,1012, so that the magnet pieces 1013,1014 may adhere to each other by magnetic force, while the areas outside the clasp 1010 is free from a magnet force. To provide additional magnetic shield, the wearable band may have removal or fixed magnet shields 1093,1094 which are sufficiently large to attach and cover the outer surfaces of the band. In a preferred embodiment, the shields are made of Mu shielding material.

Figure 11:
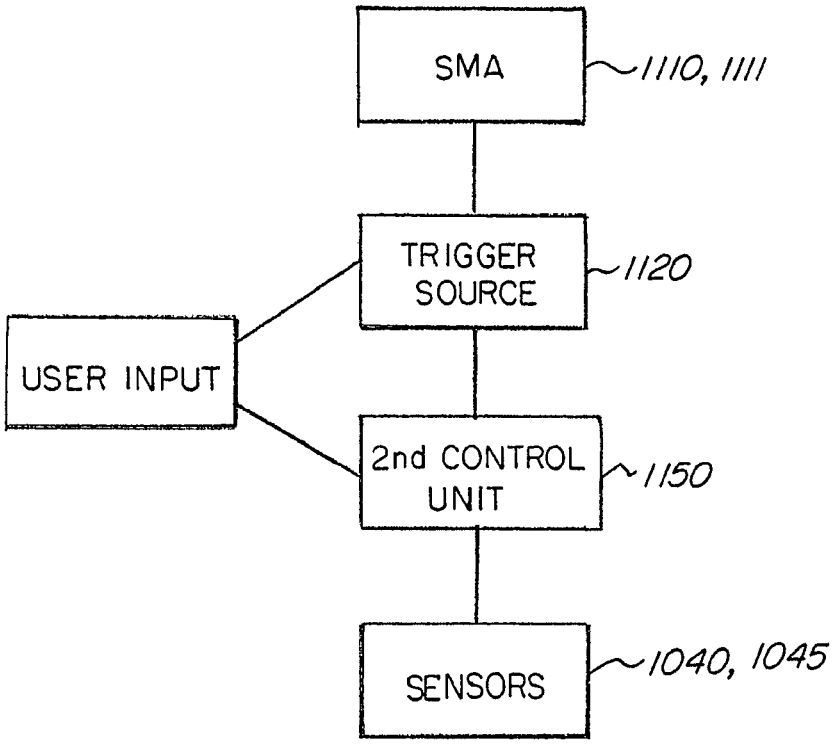
FIG. 11 shows a schematic view of an embodiment having a different mechanism to stimulate a shape memory alloy according to the embodiment.
Figure 12:
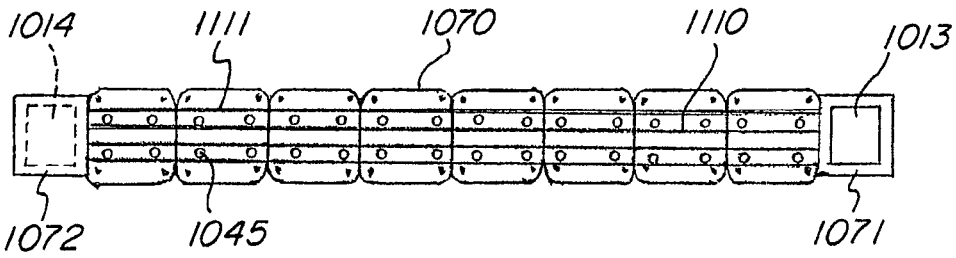
FIG. 12 shows an enlarged cross-sectional view of an embodiment of a wearable band having an adjustable magnetic clasp in its open position.

In a preferred embodiment, the wearable band 1000 shown in FIGS. 10A and 10B further comprises a shape memory material 1110 enclosed in the flexible elongated band 1070 and a trigger source 1120 configured to communicate with and further provide a stimulus to the shape memory material 1110, as shown in the block diagram of FIG. 11. The shape memory material 1110 may consist of a shape memory metal alloy 1111, such as Nitinol, in the form of wires, rods, cables, 3d printed ink, or some other construction. FIG. 12 shows an example of the flexible elongated band 1070 composed of multiple solid links which has four shape memory alloy wires 1111 running cross all of the solid links in parallel. A skilled artisan will understand that the present invention may encompass different number of the wires and other types of the shape memory material.

The shape memory material 1110 and the trigger source 1120, including the corresponding sensors and user input unit communicated with the trigger source 1120, are similar to those described previously with respect to FIGS. 8, 9A, 9B, 9C, and 9D. Therefore, the details of these components will not be repeated here.

One advantage of the above described wearable band shown in FIG. 12 is that the wearable band may self-clasp and self-adjust the tightness of the band to a predetermined level, without need of using a hand, upon laying the band onto a body part. Moreover, during wearing, the wearable band may automatically self-adjust its tightness so that a preferred tightness level is substantially maintained despite daily activities.

In one embodiment, the wearable band having the magnetic clasp 1000 with a motor may be attached to a smart watch 1080. There are a series of touch sensors 1045 dispersed, preferably evenly, on the interior surface of the flexible elongated band 1070, wherein the touch sensors 1045 are used to determine contact and tension of the band. The touch sensors may be in the form of a touch contact pad of a few millimeters thick with adhesive backing attached to the back of the watch/belt/jewelry band. Such thin touch sensors do not cause any difference in feel of the back of the watch to the wearer.

Although gravity force on the band is not required during initial positioning of the device, in the example provided here, upon laying the smart watch 1080 on a wrist, the band falls naturally by gravity and the two end portions of the band may be substantially parallel to each other and be apart by a distance of about or slightly more than the width of a wrist. The touch sensors 1045 detect the contact and send a signal to the trigger source 1120, which in turn applies electric current to the shape memory metal alloy 1111 so the shape memory alloy 1111 may be heated because of the current inputted continuously. When the temperature of the shape memory alloy 1111 reaches a phase transition temperature, the shape memory alloy 1111 may return back to its original shape, causing the flexible elongated band 1070 to bend moving its two end portions 1071,1072 toward each other, as shown in FIG. 10B. The phase transition temperature may require that the SMA (Shape Memory Alloy, such as nitinol in the example presented) or SMP (Shape Memory Polymer) or combinations thereof (or, composite) used, have some type of insulating material surrounding it to prevent heat discomfort or superficial skin irritation. Alternatively, the SMA/SMP/or composite, may be placed within the band deep enough so that the band itself insulates the skin from whatever small temperature elevations result during phase change. The two end portions 1071,1072 contain two magnet pieces 1013,1014, respectively. Since the magnetic force of attraction increases dramatically with a decrease in the distance, the two magnet pieces 1013,1014, now in closer distance, shorter than a threshold distance, automatically clasp forming an overlap. The same sensors 1045 may detect the tensioning of the band, and send sensed information to the first control unit 1050, which in turn, may transmit a signal to activate the motor 1020 in order to loosen or tighten the band to a desired tightness level. There is no hand required to enable the clasping and tightening of the band. This process is essentially a hand-free self-assembly process.

When the band is equipped with a watch, as in the above example, the band is in the form of two half bands, separated by the watch. In that case, even if the two half bands are constructed substantially the same, the shape memory alloys therein may not be triggered or reacted at the same time because a user may not put the watch on a wrist appropriately. That will not affect the two end portions 1071,1072 being brought closer in distance to enable the automatic clasp of the magnetic pieces 1013,1014. This is because the shape memory alloy wires, upon stimulation, will transform to their original form (a more stable form). The first sensor to be activated will notify via the Bluetooth or other communication mechanism the side of the band which is always programmed to close first in the sequence to actually close first. This establishes the closure sequence while at the same time allows the SMA-band to correct for misalignment that may occur when applying the watch as its opposite band morphs into its desired shape. Thus, the shape memory alloy wires that first curve in upon receipt of stimulus will stay in that shape. Once the other shape memory alloy wires curve in, the two magnetic pieces 1013,1014 will clasp. It is anticipated that the two half bands will be stimulated with a slight time delay of not more than a millisecond or two apart. To facilitate the timing of the stimulations to the shape memory alloy wires, it is not necessary to house all the electronics in communication with the two sets of shape memory alloy wires in one place, although this is may be done as well, for example, in the watch that is attached to the two half bands, in one of the multiple solid links of the band, or in a buckle of the band.

Timing of the approximation and closure of each side of the clasp also requires a signal to be transmitted to activate each side of the clasp to implement its closure mechanism. One side of the band or clasp must be activated to close first, and then on a very short time delayed basis the opposite side begins closure, so that each side of the clasp can close over or articulate appropriately with the opposite side. This allows the adjusting motor to slide the sides of the clasp over one another and create final shortening or elongation adjustment desired. This communication between each side of the clasp-band assembly is over the air—i.e. RFID, Bluetooth, infra-red motion sensors, or other airwave communication mode so as to time the closure of each side appropriately.

In a preferred embodiment, a remote control unit wirelessly, for example, via a blue tooth device, communicates with the shape memory alloy wires in each of the two half bands. The remote control unit initiates a first half band to bend with its end moving toward the center of the arc of desired motion, and then within milliseconds, initiates a second half band to bend with the end moving along the same arc of motion so that the two ends are aligned on top of each other with a magnetic piece on each end facing each other before clasping, while compensating automatically for any mal-position that may occur when initially laying the watch on the wrist area.

During wearing, the touch sensors 1045 continuously detects the tensioning of the band and alert to the first control unit 1050 and/or a second control unit 1150 the need to adjust the band length. The first control unit 1050 and/or the second control unit 1150 then trigger the activation of the motor 1020 and/or the trigger source 1120 in order to adjust the length and compensate for the changes, thereby substantially maintaining the desired tightness.

According to another embodiment, the initial deformation of the shape memory metal alloy 1111 may be triggered by a user (instead of being triggered by the touch sensors 1045). Upon laying the smart watch 1080 with the wearable band on a wrist, a user may manually enter an instruction on the touch screen of the smart watch 1080 to request the trigger source 1120 to send a stimulus (e.g., application of electric current) to the shape memory alloy 1111. Alternatively, a user may use a push button on the band if so configured to trigger the self-assembly process. The band will automatically clasp and tighten itself and substantially maintain its preferred tightness without involvement of a hand.

As disclosed previously, the sensors in accordance with the present invention may be configured such that the number, configuration, or pattern of the sensors in contact with an object will determine the timing for closing the band and tensioning of the band. Thus, in a preferred embodiment, a user may select a certain number, configuration, or pattern of sensors inputs as coded in the user controls of the device mechanism prior to triggering the phase transition of the memory shape as described above. That way, the user not only set a level of tightness of the band but also control the response time of the band in maintaining the desired tightness level. As such, the present invention provides customized smart wearable bands.

It will also be clear that various alterations and/or improvements evident to those skilled in the art may be made to the embodiments forming the subject of this specification without departing from the scope of the present invention defined by the annexed claims.

What is claimed is:

1. A wearable band having a self-adjusting clasp, said band comprising:

a flexible elongated band having two end portions, a clasp having a first and a second clasp members attached to the two end portions of the flexible elongated band, the first clasp member having a first magnet piece, the second clasp member having a second magnet piece, the two end portions of the band being separable from one another in an open position of the band and being configured to mutually attract and magnetically connect to each other to form an overlap in a closed position of the band, a motor disposed in the first clasp member, the motor being configured to adjust a position of the clasp with respect to the band in order to tighten or loosen the band, sensors disposed on an interior surface of the band, and a control unit in communication with the motor and the sensors, wherein the control unit is configured to control activation of the motor based on measurements provided by the sensors.

2. The wearable band of claim 1, wherein the control unit is configured to start the activation of the motor if the measurements provided by the sensors are higher or lower than a predetermined threshold value, and wherein the control unit is configured to cease the activation of the motor if the measurements provided by the sensors reach the predetermined threshold value.

3. The wearable band of claim 1, further comprising a user input unit in the form of a switch, a knob, or a push button attached to a buckle of the band, or a touch screen of a smart phone attached to the band, wherein the user input unit in communication with the control unit, wherein the control unit controls the activation of the motor in response to instructions provided by the user input unit.

4. The wearable band of claim 1, further comprising a magnet shield surrounding surfaces of the clasp members and the band.

5. The wearable band of claim 1, further comprising:

a shape memory material disposed in the flexible elongated band, and a trigger source in communication with the shape memory material, wherein the shape memory material is shape memory polymer, shape memory alloy, or a combination thereof;

wherein the trigger source is configured to provide a stimulus to the shape memory material, wherein the shape memory material is configured to transition between a memorized shape and a temporary shape upon receipt of a stimulus, wherein the control unit in communication with the trigger source, and wherein the control unit is configured to instruct the trigger source to provide a stimulus to the shape memory material based on measurements provided by the sensors.

6. The wearable band of claim 5, wherein the sensors are touch sensors, the touch sensors being configured to detect the contact of the band with a body part and tension information between the band and a body part; and wherein upon laying the band on a body part, the touch sensor sends signals to the control unit, which instructs the trigger source to provide a stimulus to the shape memory material, causing the flexible elongated band to bend and the two magnet pieces to move towards each other and clasp to form the overlap by magnetic force.

7. The wearable band of claim 5, wherein the trigger source is in communication with a user input unit, wherein the user input unit is a touch screen of a smart phone attached to the band, wherein the trigger source is configured to provide a stimulus to the shape memory material in response to an input provided by the user input unit, and wherein upon laying the band on a body part, an user input is provided through the user input unit, and the trigger source provides a stimulus to the shape memory material in response to the user input causing the flexible elongated band to bend and the two magnet pieces to move towards each other and clasp to form an overlap by magnetic force.

8. The wearable band of claim 5, wherein the stimulus is application of electric current.

9. The wearable band of claim 5, wherein the flexible elongated band is in the form of multiple solid links, wherein the shape memory material is shape memory alloy in the form of elongated wires; and wherein the shape memory alloy wires are dispersed throughout the multiple solid links.

10. The wearable band of claim 9, wherein part of the links of the multiple solid links are removable and the length of the shape memory alloy wires is adjustable.

11. The wearable band of claim 8, further comprising a battery housed in a buckle of the band for supplying power to the motor, the control unit, and the sensors, and/or for creating electric current to apply to the shape memory material.

12. The wearable band having a self-adjusting clasp, said band comprising:

a first half band having a proximal end and a distal end, a second half band having a proximal end and a distal end, wherein the proximal end of the first half band the proximal end of the second half band are connected to each other via an article, a clasp having first and second clasp members attached to the two distal ends of the first and second half bands respectively so as to open and close the band, sensors disposed on the first and second half bands, a motor disposed in one of the first and second clasp members, the motor being configured to adjust a position of the clasp with respect to the band, a control unit, wherein the control unit in communication with the motor and the sensors, wherein the control unit is configured to control activation of the motor based on measurements provided by the sensors in order to tighten or loosen the band, a first shape memory material disposed in the first half band, a second shape memory material disposed in the second half band, a first trigger source in communication with the first shape memory material, a second trigger source in communication with the second shape memory material, wherein the first and second trigger sources are configured to provide a stimulus to the first and second shape memory materials, respectively, wherein each of the first and shape memory materials is configured to transition between a memorized shape and a temporary shape upon receipt of a stimulus, wherein the control unit in communication with the first and second trigger sources, wherein the control unit is configured to instruct the first and second trigger sources to provide a stimulus to the first and second shape memory materials, respectively.

13. The wearable band of claim 12, further comprising a user input unit in the form of a switch, a knob, or a push button attached to a buckle of the band, or a touch screen of a smart phone or a smart watch, wherein the control unit is in communication with the user input unit and controls the activation of the motor and the first and second trigger sources according to instructions provided by the user input unit.

14. The wearable band of claim 13, wherein the sensors are distributed evenly on an interior surface of the band;

wherein the sensors are configured such that number, configuration, and pattern of the sensors in contact with an object determines timing for closing the band and tensioning of the band; and wherein a user selects number, configuration, and pattern of the sensors to be in contact with an object and enters the selections in the user input unit so as to control timing for closing the band and tensioning of the band.

15. The wearable band of claim 12, wherein the control unit is configured to instruct the first trigger source to provide a stimulus to the first shape memory material in response to an input provided by the user input unit or in response to a sensed information provided by the sensors upon laying the band on a body part, causing the first half band to curve with its distal end moving toward the center of an arc of a closed position of the band, and wherein, within milliseconds, the control unit instructs the second trigger source to provide a stimulus to the second shape memory material, causing the second half band to curve its distal end and move toward the center of the arc of the closed position of the band, thereby facilitating the clasp of the first and second clasp members.

16. The wearable band of claim 15, wherein the stimulus is application of electric current.

17. The wearable band of claim 15, wherein the first clasp member having a first magnet piece, and wherein the second clasp member having a second magnet piece.

18. The wearable band of claim 17, wherein the control unit is further configured that, before clasping, the control unit instructs the motor to adjust the position of the second clasp member so that the two distal ends are aligned on top of each other with a magnetic piece on each end facing each other, thereby facilitating the two magnetic pieces to clasp by magnetic force.

19. The wearable band of claim 12, wherein the control unit is further configured to initiate activation of the motor if measurements provided by the sensors are higher or lower than a predetermined threshold value; and wherein the control unit is configured to cease the activation of the motor if measurements provided by the sensors reach the predetermined threshold value.

20. A self-adjusting clasp comprising:

a first clasp member having a first magnet piece, a second clasp member having a second magnet piece, the first and the second clasp members being separable from one another in an open position of the clasp and being configured to mutually attract and magnetically connect to each other to form an overlap of the first and the second clasp members in a closed position of the clasp;

an anchor mechanism for attaching to a band, a motor disposed in the first clasp member, the motor being configured to adjust a position of the anchor mechanism with respect to the rest of the clasp, at least one sensor, and a control unit in communication with the motor and the at least one sensor, wherein the control unit controls activation of the motor based on measurements provided by the at least one sensor.

21. The self-adjusting clasp of claim 20, wherein the motor is a worm-gear motor, a lead screw actuator, or a rack and pinion motor.

22. The self-adjusting clasp of claim 21, wherein the motor comprises a driveshaft and a gear, the gear being configured to engage with the anchor mechanism such that the gear, when moving in response to activation of the motor, adjusts a position of the anchor mechanism with respect to the rest of the clasp.

23. The self-adjusting clasp of claim 20, wherein the at least one sensor is a touch sensor, a pressure sensor, a capacitive sensor, a conductivity sensor, a light sensor, a heat sensor, a strain gauge, a stress gauge, a bend sensor, or a combination thereof.

24. The self-adjusting clasp of claim 20, wherein the control unit initiates activation of the motor if measurements provided by the at least one sensor are higher or lower than a predetermined threshold value; and wherein the control unit ceases the activation of the motor if measurements provided by the at least one sensor reach the predetermined threshold value.

25. The self-adjusting clasp of claim 20, wherein the clasp further comprises a user input unit in communication with the control unit; and wherein the control unit receives an instruction from the user input unit and controls the activation of the motor according to the instruction.

26. The self-adjusting clasp of claim 20, wherein the control unit is housed in one of the first and second clasp members.

27. The self-adjusting clasp of claim 20, further comprising a magnet shield surrounding surfaces of the first and second clasp members.

28. The self-adjusting clasp of claim 20, further comprising a second motor disposed on the second clasp member, the second motor being configured to adjust a position of the anchor mechanism with respect to the rest of the clasp.

* * * * *